US009415276B1

(12) United States Patent
Hao

(10) Patent No.: US 9,415,276 B1
(45) Date of Patent: Aug. 16, 2016

(54) FITNESS BALL CHAIR

(71) Applicant: PLUS 'O'MINUS FITNESS PRODUCTS (SUZHOU) CO., LTD., Suzhou (CN)

(72) Inventor: Szu-Chia Hao, Taipei (TW)

(73) Assignee: PLUS 'O'MINUS FITNESS PRODUCTS (SUZHOU) CO., LTD., Suzhou, Jiang Su Province (CN)

( * ) Notice: Subject to any disclaimer, the term of this patent is extended or adjusted under 35 U.S.C. 154(b) by 3 days.

(21) Appl. No.: 14/664,926

(22) Filed: Mar. 23, 2015

(30) Foreign Application Priority Data

Feb. 17, 2015 (TW) ..... 104202814 U

(51) Int. Cl.
*A63B 26/00* (2006.01)
*A63B 41/00* (2006.01)
*A47C 1/00* (2006.01)
*A63B 21/055* (2006.01)

(52) U.S. Cl.
CPC . *A63B 41/00* (2013.01); *A47C 1/00* (2013.01); *A63B 21/0552* (2013.01); *A63B 26/00* (2013.01)

(58) Field of Classification Search
USPC ..... 482/1–148
See application file for complete search history.

(56) References Cited

U.S. PATENT DOCUMENTS 5,833,587 A * 11/1998 Strong ..... A63B 21/154 482/121
6,375,601 B1 * 4/2002 Johnson ..... A63H 1/0292 297/452.13
6,730,005 B1 * 5/2004 Liao ..... A47C 3/16 446/220
6,746,372 B2 * 6/2004 Hsu ..... A47C 9/002 482/123
D521,084 S * 5/2006 Huang ..... D21/662
7,044,558 B2 * 5/2006 Chiu ..... A47C 4/54 297/217.1
7,118,517 B1 * 10/2006 Hale ..... A63B 21/4015 482/140
7,311,644 B2 * 12/2007 Hale ..... A63B 21/4015 482/132
7,344,487 B2 * 3/2008 Carter ..... A63B 21/0552 482/142
7,674,216 B1 * 3/2010 Bolling ..... A63B 23/03516 446/220
7,691,036 B1 * 4/2010 Julian ..... A61H 1/0292 482/110
7,901,339 B2 * 3/2011 Schechter ..... A63B 21/00047 482/142
7,942,796 B2 * 5/2011 Signorile ..... A63B 26/003 482/142
8,056,976 B1 * 11/2011 Polk ..... A47C 3/029 297/258.1
8,235,878 B2 * 8/2012 Signorile ..... A63B 26/003 482/142
8,702,574 B2 * 4/2014 Abranchess ..... A63B 21/0004 482/141
8,734,307 B2 * 5/2014 Bathey ..... A63B 21/068 482/142
8,882,642 B2 * 11/2014 Chavez ..... A63B 21/0442 482/121
9,242,139 B2 * 1/2016 Holley ..... A63B 23/02
2008/0261789 A1 * 10/2008 Hsu ..... A63B 23/03575 482/140
2011/0183827 A1 * 7/2011 Radi ..... A63B 21/00047 482/140
2013/0154333 A1 * 6/2013 Wu ..... A47C 9/0002 297/452.23
2015/0133279 A1 * 5/2015 Alessandri ..... A63B 21/0023 482/142

* cited by examiner

*Primary Examiner* — Stephen Crow
(74) *Attorney, Agent, or Firm* — Leong C. Lei

(57) ABSTRACT

A fitness ball chair includes a base, a fitness ball, a support tube and a pad. The base is an elastic structure formed by being spirally enclosed and having an opening in the middle of the base. The fitness ball is movably disposed in the base, and a portion of the fitness ball is disposed in the opening to prevent the fitness from falling out. The support tube is provided for connecting the base and the pad and supporting a user's trunk. The fitness ball is positioned and stored in the base. With the elastic design of the base and the softness of the fitness ball, the fitness ball chair provides a good exercise and protection effects to users, and causes no waste of the using space.

11 Claims, 7 Drawing Sheets

FITNESS BALL CHAIR

CROSS-REFERENCE TO RELATED APPLICATIONS

This non-provisional application claims priority under 35 U.S.C. §119(a) on Patent Application No(s). 104202814 filed in Taiwan, R.O.C. on Feb. 17, 2015, the entire contents of which are hereby incorporated by reference.

BACKGROUND OF THE INVENTION

1. Field of the Invention

The present invention relates to the field of fitness equipments, and more particularly to a fitness ball chair provided for placing and positioning a conventional fitness ball, allowing users to do more and safer fitness exercises, and offering a good way of storage.

2. Description of the Related Art

Nowadays, people have chronic diseases such as mood disorder, manic depression, insomnia and even obesity caused by pressure of life, and these chronic diseases are generally the result of lacking appropriate and regular exercises and habits, and moderate exercises are an effective way to stay healthy and keep fit and are very helpful to maintain good metabolism and physical strength.

Therefore, various types of fitness equipments are available in the market to provide all kinds of exercises and fitness effects to users. Wherein, fitness ball is an exercise tool that combines fitness exercise with a ball sport. With the advantage of a light weight, the fitness ball which is an inflatable ball made of a PVC material becomes increasingly popular. Through the contact of the fitness ball with human body, the inflatable design of such ball is capable of providing a soft support effect to the user's body, achieving a preliminary massage effect to promote blood circulation of the user.

The fitness ball exercise is a comprehensive and diversified exercise that trains muscles at major parts such as abdomen, back and waist of the users. In cooperation with the slow and rhythmic breathing and different stretching and pressing motions during the exercise, the fitness ball exercise achieves the effects of contracting, supporting and massaging the muscles as well as burning fats. In addition, the exerciser's focus and the endurance of the exerciser's limbs and vertebra are improved during the exercise process.

However, the structure of a conventional fitness ball is very large, which is very inconvenient to inflate and deflate the fitness ball, and thus it is difficult to store the ball after finishing the exercise. Further, the fitness ball does not move in a specific direction, so that there is a potential risk to children if the ball is placed freely anywhere. Even if there are places to store the ball, it will occupy and waste too much space, not just failing to play its role only, but also resulting in awkward appearance and inconvenience of use. During the process of the fitness ball exercise, the ball may be moved unintentionally due to the exerciser's wrong movement, and the exerciser may lose support, fall, or get hurt. Therefore, a fixing disk for fixing the fitness ball was introduced to the market, but the structural design of such fixing disk generally does not provide to much contact with the surface of the fitness ball, so that when the fitness ball is pressed and deformed, the fall may be separated from the fixing disk. Obviously, the conventional fitness ball still has potential risks and requires further improvements.

Therefore, the inventor of the present invention designed and developed a fitness ball chair in accordance with the present invention to overcome the aforementioned drawbacks and problems of the prior art.

SUMMARY OF THE INVENTION

In view of the problems of the prior art, it is a primary objective of the present invention to provide a fitness ball chair comprising a base formed by being spirally enclosed and having an opening formed at the middle of the base and provided for positioning and accommodating a fitness ball. With the elastic design of the base and the softness of the fitness ball, the invention provides good exercise and protection effects to users. In addition, a support tube and pad is installed to a side of the base for supporting a user's trunk and improving the safety of use.

Another objective of the present invention is to provide a fitness ball chair comprising a plurality of wheels installed at the bottom of the base to facilitate the transportation of the fitness ball chair.

A further objective of the present invention is to provide a fitness ball chair comprising a rope pulling device for training the muscles of both hands of the user in addition to doing exercise by using the fitness ball, so as to improve the exercise effect significantly.

To achieve the aforementioned and other objectives, the present invention provides a fitness ball chair, comprising: a base, being an elastic structure formed by being spirally encircled and having an opening formed in the middle of the base; a fitness ball, being an inflatable ball movably disposed in the base, and having a portion disposed in the opening to prevent the fitness ball from falling out; a support tube, having two ends which are a first end and a second end, and the second end being coupled to the base; a pad, installed at the first end, for supporting a user's trunk, and providing a protection effect to the user by the softness of the fitness ball and the elasticity of the base during the use of the fitness ball. Of course, the fitness ball of the present invention may be removed from the fitness ball chair and used alone, so as to improve the scope and effect of the exercise.

Wherein, the opening is greater than or equal to ⅓ of the radius of the fitness ball, and the base has a height smaller than or equal to ½ of the radius of the fitness ball. Such design keeps the fitness ball in the base and prevents it from falling out, so as to improve the safety of use and the stability of exercise.

Wherein, the support tube includes a first tube, a second tube and a third tube, each being a hollow tubular structure, and the first tube is upwardly installed to the bottommost part of the base, and the second tube is sheathed on the other end of the first tube, and the third tube is sheathed on the other end of the second tube, and the pad is fixed to the other end of the third tube. The first tube, the second tube and the third tube are arc shaped, and the second tube relative to the first tube and the third tube relative to the second tube have a plurality of pin holes provided for inserting and fixing a plurality of pins respectively and adjusting the using length of the support tube to fit different heights of the users.

In an embodiment of the present invention, the fitness ball chair further comprises a plurality of wheels installed at the bottommost part of the base, and each wheel includes a connecting tube coupled between each wheel and the base. Each connecting tube is formed by connecting a first connecting tube and a second connecting tube, and the first connecting tube is fixed to the bottom of the base, and the second connecting tube is coupled to the wheel, and the first connecting tube relative to the second connecting tube has a plurality of pin holes provided for inserting and fixing a plurality of pins respectively, so as to adjust the height of the base and facilitate the users' exercise.

In an embodiment of the present invention, the fitness ball chair further comprises a rope pulling device formed by a pair of elastic pull ropes and symmetrically installed on the base at both sides of the support tube. The rope pulling device is provided for training the muscle group of both hands of the users. In addition, each elastic pull rope has a ring belt disposed at an end of the elastic pull rope, and the ring belt includes a handle sheathed thereon, and each elastic pull rope has a connector disposed at the other end of the elastic pull rope. Each connector includes a connecting ring and a movable buckle, and the connecting ring is installed to the base, and the movable buckle is installed at the other end of the elastic pull rope, and the movable buckle is buckled with the connecting ring to define a connection for use. The connector is provided to facilitate installation and removal for maintenance, repair, or replacement.

In addition, the present invention further comprises a plurality of cushions installed on a surface opposing to the fitness ball to enhance the frictional effect of the fitness ball, so that the ball will not be rotated during exercise. The cushions not just improves the safety of exercise only, but also protects the fitness ball and the paint on the surface of the base and minimizes the noise produced during the use of the fitness ball chair.

DETAILED DESCRIPTION OF THE PREFERRED EMBODIMENTS

The technical content of the present invention will become apparent with the detailed description of preferred embodiments and the illustration of related drawings as follows.

Figure 1:
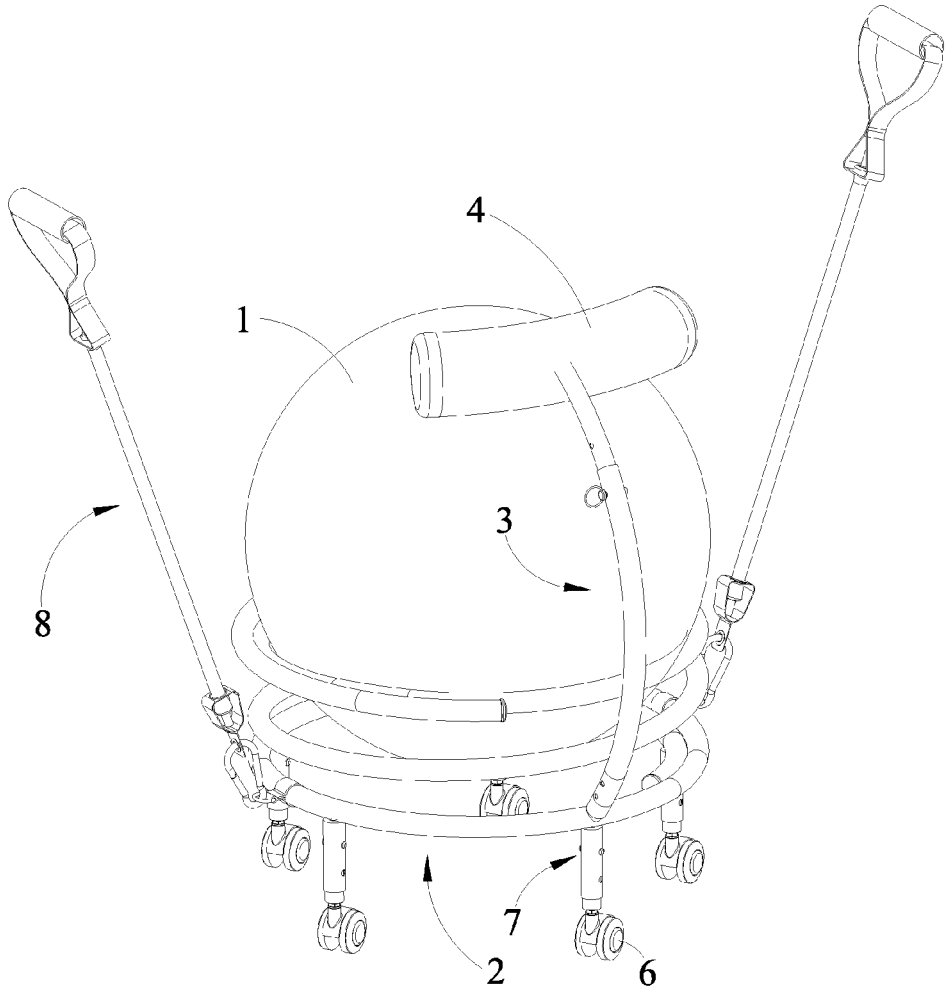
FIG. 1 is a schematic view of a preferred embodiment of the present invention.
Figure 2:
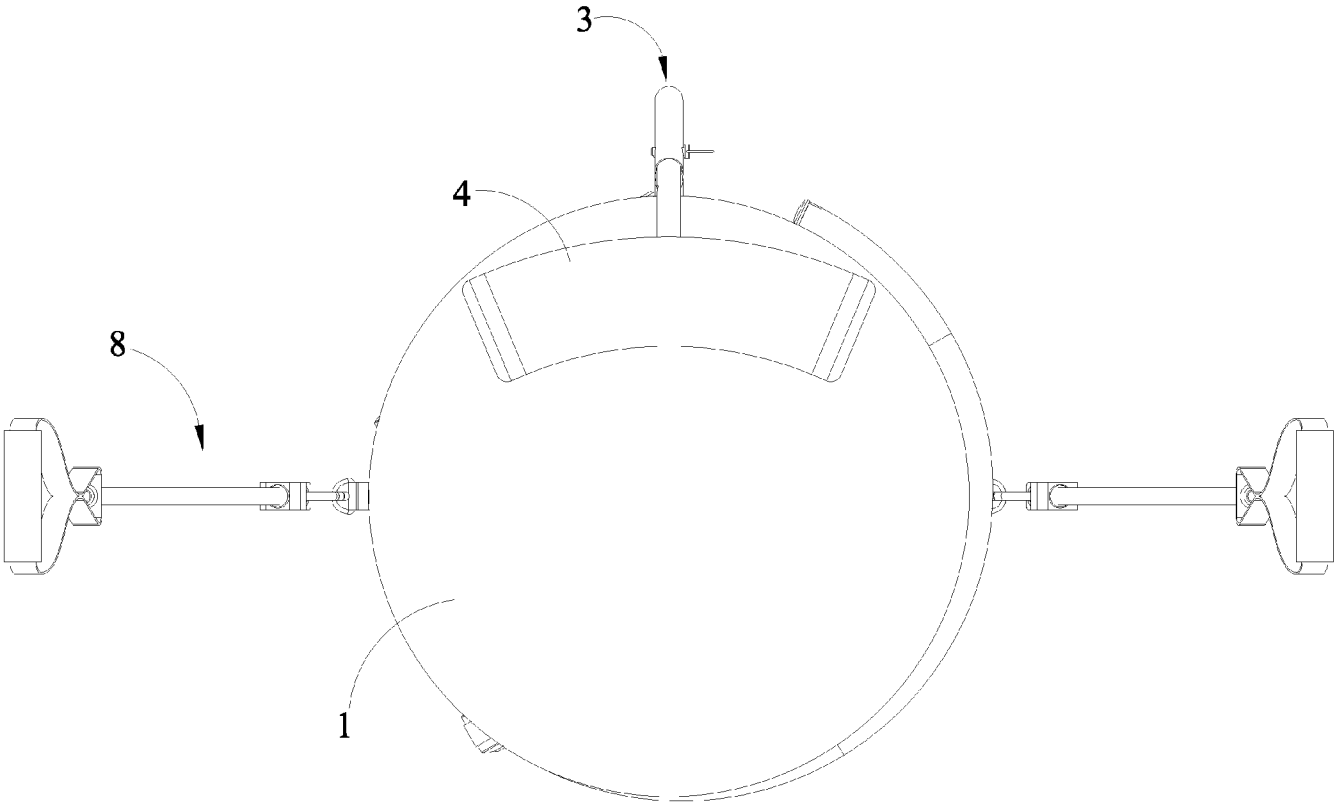
FIG. 2 is a bottom view of a preferred embodiment of the present invention.
Figure 3:
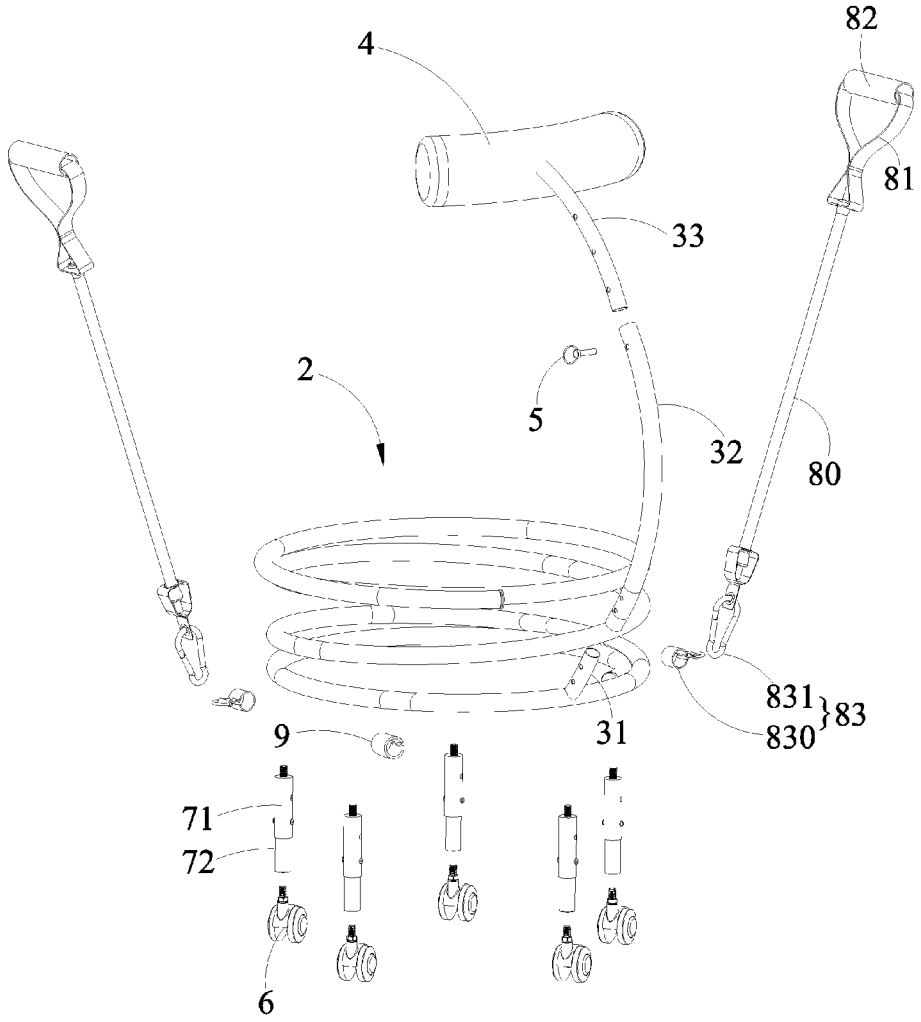
FIG. 3 is an exploded view of a preferred embodiment of the present invention.
Figure 4:
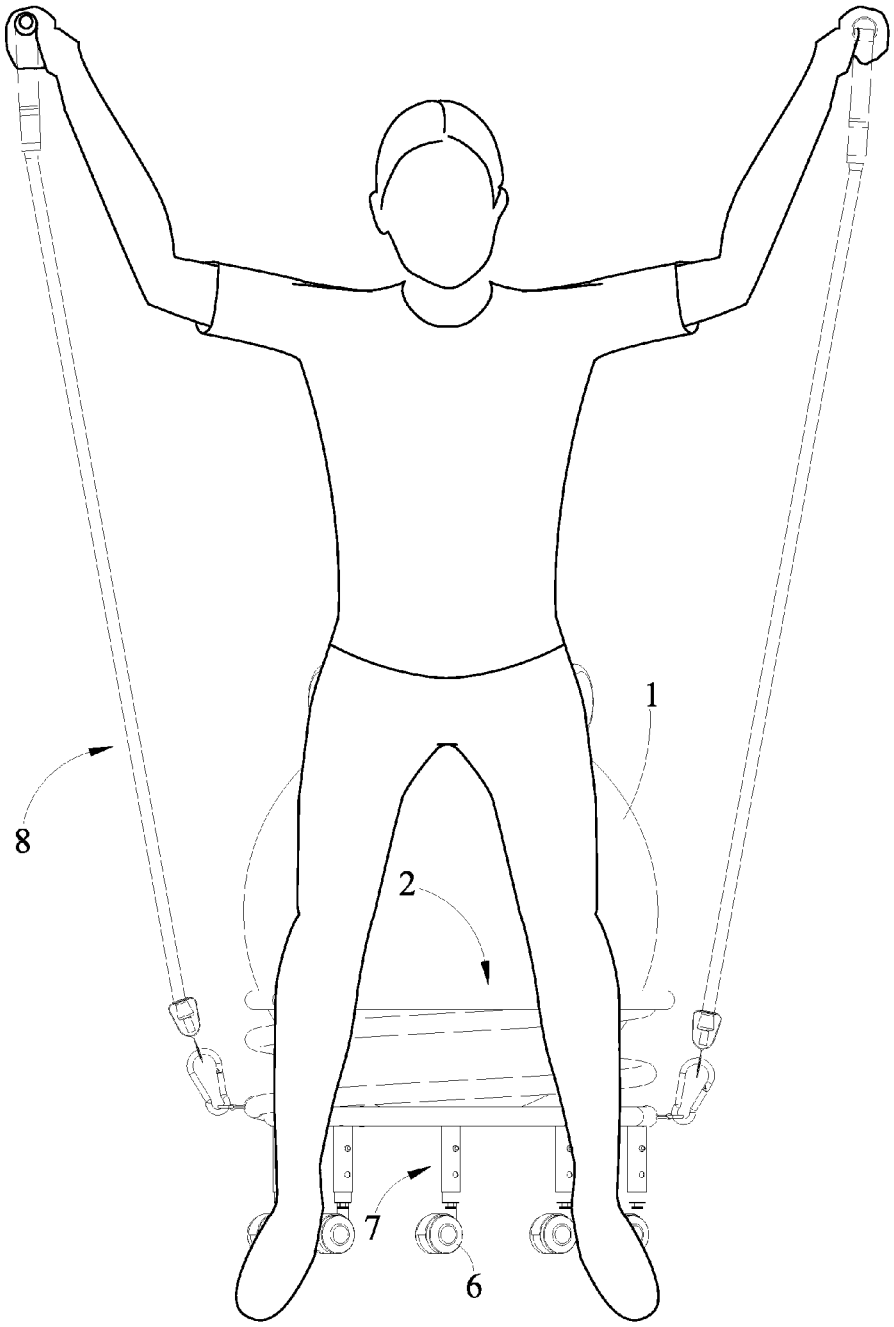
FIG. 4 is a schematic view of a using status of a preferred embodiment of the present invention.
Figure 5:
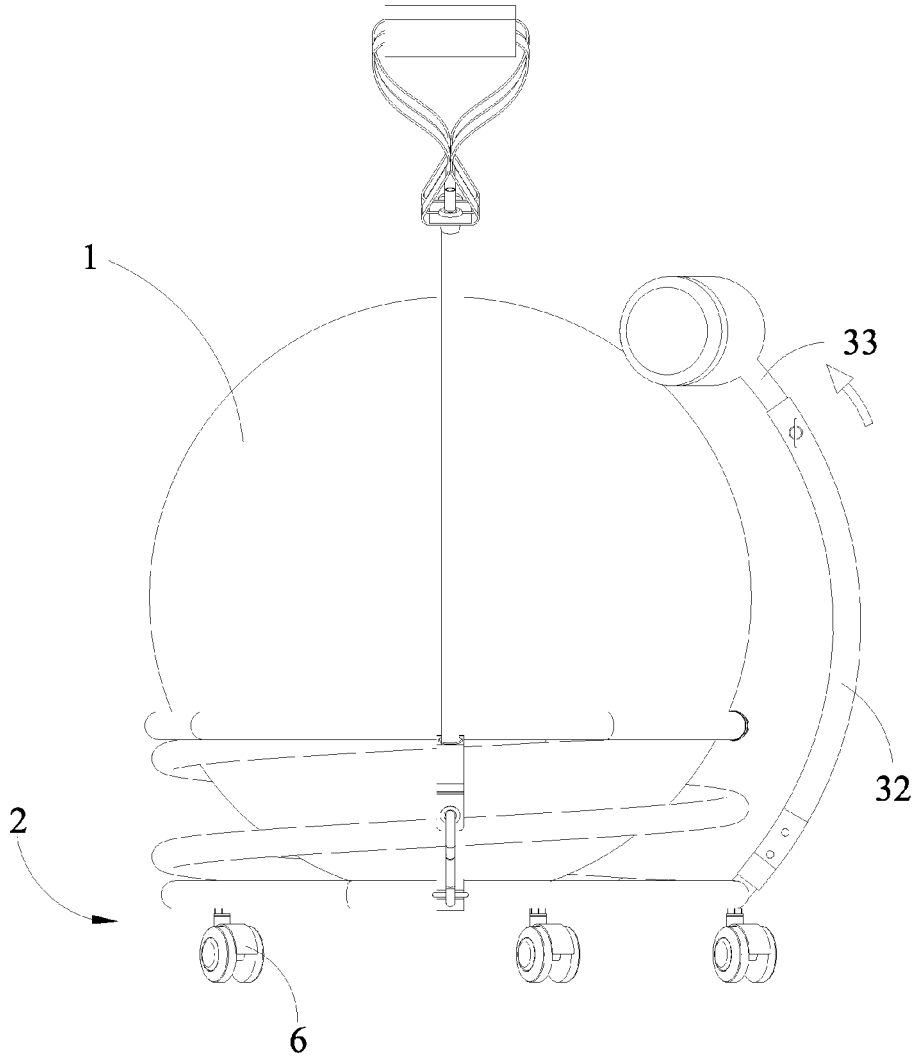
FIG. 5 is a first schematic view of and adjusted status of a preferred embodiment of the present invention.
Figure 6:
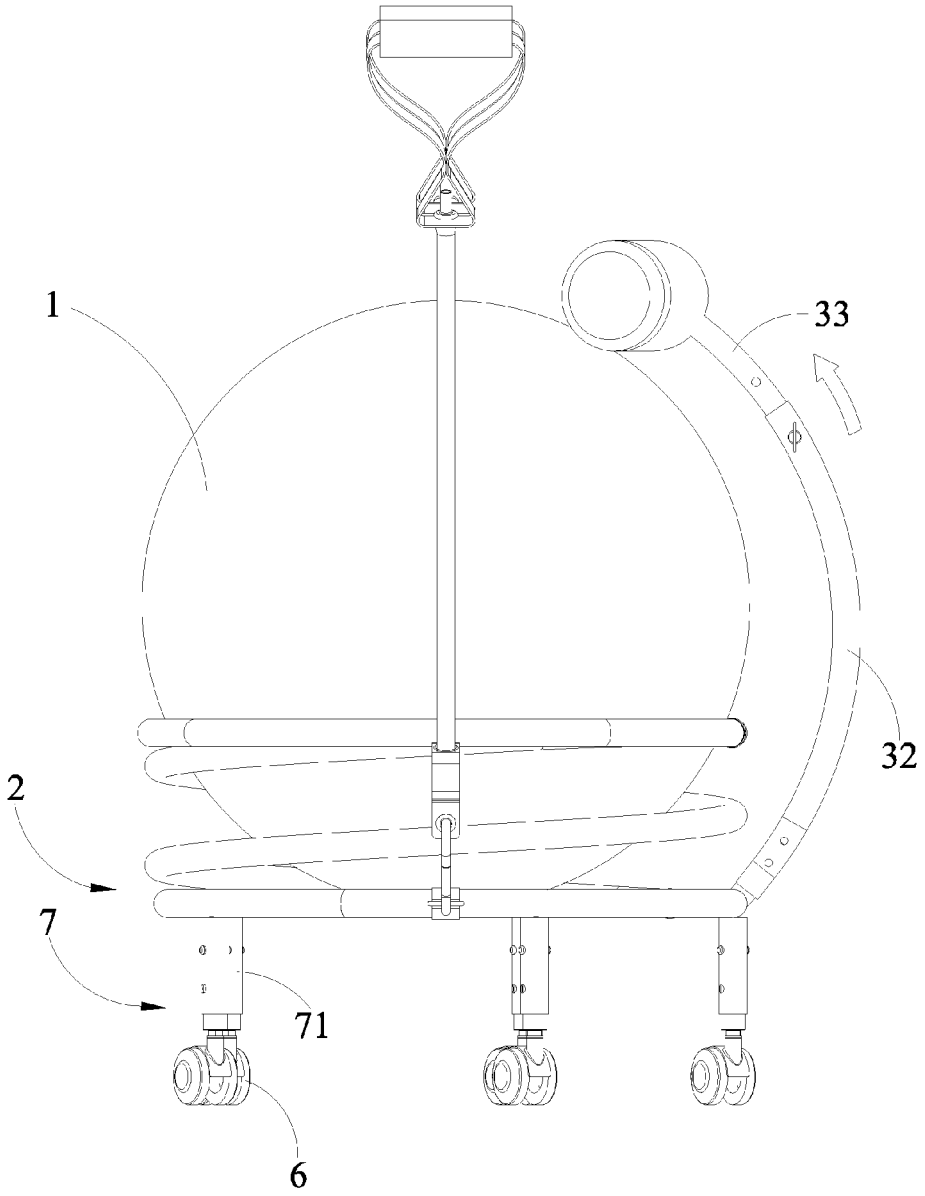
FIG. 6 is a second schematic view of and adjusted status of a preferred embodiment of the present invention.
Figure 7:
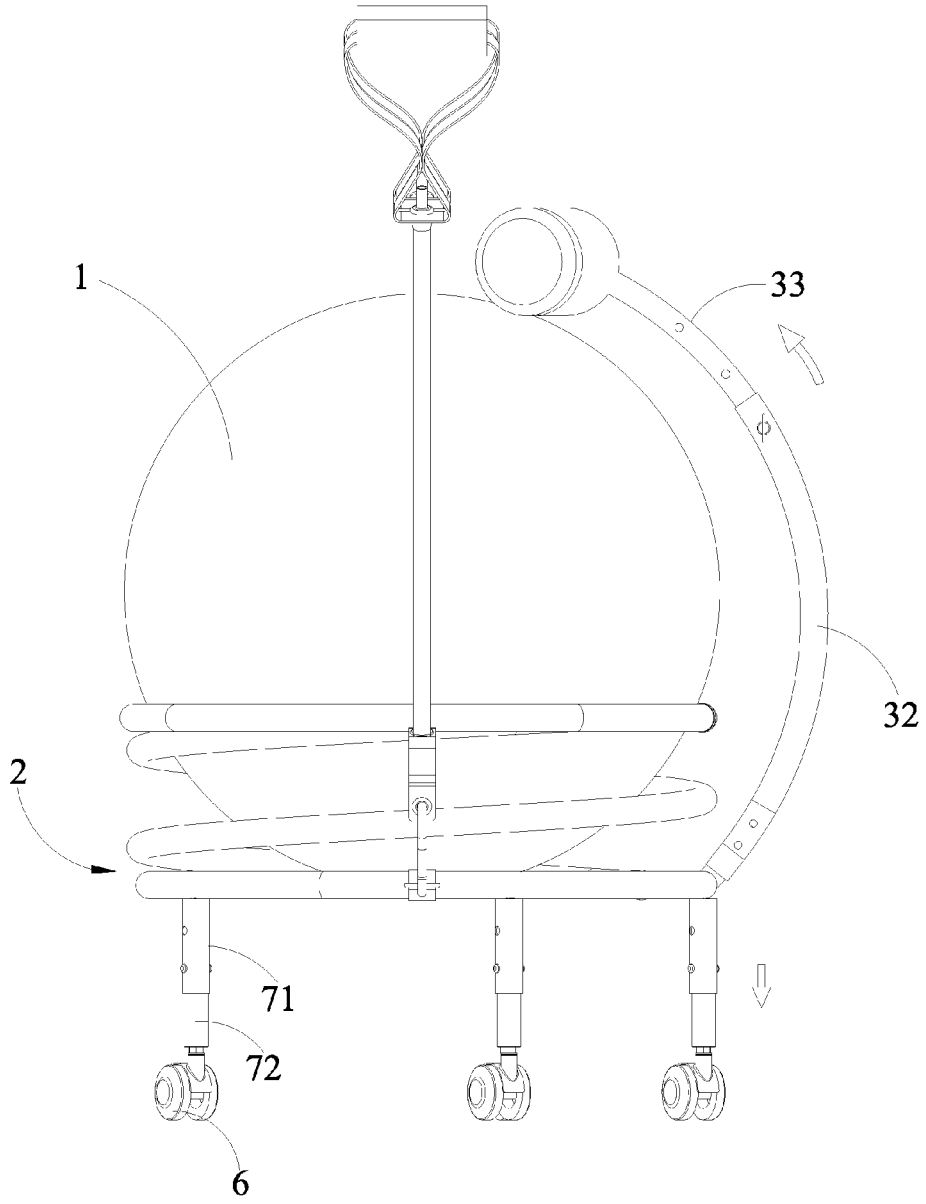
FIG. 7 is a third schematic view of and adjusted status of a preferred embodiment of the present invention.

With reference to FIGS. 1 to 4 and 5 to 7 for a schematic view, a bottom view, a and a perspective view of a fitness ball chair and schematic views of different using statuses of the fitness ball chair and different adjusting statuses of the fitness ball chair in accordance with a preferred embodiment of the present invention respectively, the fitness ball chair comprises a base 2, a fitness ball 1, a support tube 3 and a pad 4.

The base 2 is an elastic structure formed by being spirally encircled and having an opening formed in the middle of the base, and the opening is greater than or equal to ⅓ of the radius of the fitness ball 1, and the base 3 has a height smaller than or equal to ½ of the radius of the fitness ball 1, so as to store the fitness ball 1 and prevent it from falling out during exercise.

The fitness ball 1 is an inflatable ball made of a soft PVC material, and the softness may be increased or decreased by changing the amount of inflated air. The fitness ball 1 is movably disposed in the opening of the base 2, and a portion of the fitness ball 1 is disposed in the opening to prevent the fitness ball 1 from falling out.

Both ends of the support tube 3 are a first end and a second end respectively, and the second end is coupled to the base 1. The support tube 3 includes a first tube 31, a second tube 32 and a third tube 33, each being a hollow tubular structure, and the first tube 31 is upwardly installed to the bottommost part of the base 2, and the second tube 32 is sheathed on the other end of the first tube 31, and the third tube 33 is sheathed on the other end of the second tube 32, and the pad 4 is fixed to the other end of the third tube 33. The first tube 31, the second tube 32 and the third tube 33 are arc shaped, and the second tube 32 relative to the first tube 31 and the third tube 33 relative to the second tube 32 have a plurality of pin holes for inserting and fixing a plurality of pins 5 respectively, and the support tube 3 is designed with an adjustable length to improve the using effect.

The surface of the pad 4 is made of a soft foam material and installed at the first end for supporting the user's trunk. The softness of the fitness ball 1 and the elasticity of the base 2 provide a good protection effect to the users during use.

To facilitate the transportation of the fitness ball chair, the present invention further comprises a plurality of wheels 6 installed at the bottommost part of the base 2. Each wheel 6 includes a connecting tube 7 connected between each wheel 6 and the base 2, and each connecting tube 7 is formed by connecting a first connecting tube 71 and a second connecting tube 72, and the first connecting tube 71 is fixed to the bottom of the base 2, and the second connecting tube 72 is connected to the wheel 6, and the first connecting tube 71 relative to the second connecting tube 72 has a plurality of pin holes for inserting and fixing a plurality of pins 5 respectively to provide a height adjusting design and facilitate installation and removal.

In addition, the fitness ball chair of the present invention further comprises a rope pulling device 8 formed by a pair of elastic pull ropes 80 and symmetrically installed on the base 2 at both sides of the support tube 3. In addition, each elastic pull rope 80 has a ring belt 81 disposed at an end of the elastic pull rope 80, and a handle 82 is sheathed on the ring belt 81. A connector 83 is installed at the other end of each elastic pull rope 80, and the connector 83 includes a connecting ring 830 and a movable buckle 831, and the connecting ring 830 is installed to the base 2, and the movable buckle 831 is installed at the other end of the elastic pull rope 80. The movable buckle 831 is buckled to the connecting ring 830 to define a connection for use. The installation and removal of the movable buckle 831 are very convenient, and thus improving the convenience of use.

To prevent hitting the bases 2 and protect the paint of the base 2, the base has a plurality of cushions installed on the surface of the base and opposing the fitness ball.

In summation, the present invention has the following advantages and effects:

1. With the design of the spiral elastic base 2 and the pad 4, the fitness ball 1 can be positioned and provided for a user to sit thereon. The fitness ball 1 not just provides the function of a chair cushion without occupying much space only, but also provides a good fitness exercise to users.

2. The design of the present invention may be used for fitness training or for work. With a combination of the softness of the fitness ball 1 and the elasticity of the base 2, the fitness ball exercise becomes more effectively and more comfortable and has more fun. Compared with other conventional products, the fitness ball chair of the present invention provides better buffering and supporting effects.

3. The curvature of the support tube 3 is designed ergonomically, so that the fitness ball chair is very comfortable, and the support tube 3 may be contracted or extended to adjust the height to fit different body build of the users. The support tube 3 is detachable, so that the fitness chair has a small storage volume to facilitate transportation.

What is claimed is:

1. A fitness ball chair, comprising:

a base, being an elastic structure formed by being spirally encircled and having an opening formed in the middle of the base;

a fitness ball, being an inflatable ball movably disposed in the base, and having a portion disposed in the opening to prevent the fitness ball from falling out;

a support tube, having two ends which are a first end and a second end, and the second end being coupled to the base;

a pad, installed at the first end, for supporting a user's trunk, and providing a protection effect to the user by the softness of the fitness ball and the elasticity of the base during the use of the fitness ball.

2. The fitness ball chair according to claim 1, wherein the opening is greater than or equal to ⅓ of the radius of the fitness ball, and the base has a height smaller than or equal to ½ of the radius of the fitness ball.

3. The fitness ball chair according to claim 1, wherein the support tube includes a first tube, a second tube and a third tube, each being a hollow tubular structure, and the first tube is upwardly installed to a bottommost part of the base, and the second tube is sheathed on the other end of the first tube, and the third tube is sheathed on the other end of the second tube, and the pad is fixed to the other end of the third tube.

4. The fitness ball chair according to claim 3, wherein the first tube, the second tube and the third tube are arc shaped, and the second tube relative to the first tube and the third tube relative to the second tube have a plurality of pin holes provided for inserting and fixing a plurality of pins respectively.

5. The fitness ball chair according to claim 1, further comprising a plurality of wheels installed at the bottommost part of the base.

6. The fitness ball chair according to claim 5, further comprising a connecting tube coupled between each wheel and the base.

7. The fitness ball chair according to claim 6, wherein the connecting tube is formed by connecting a first connecting tube and a second connecting tube, and the first connecting tube is fixed to the bottom of the base, and the second connecting tube is coupled to the wheel, and the first connecting tube relative to the second connecting tube has a plurality of pin holes provided for inserting and fixing a plurality of pins respectively.

8. The fitness ball chair according to claim 1, further comprising a rope pulling device formed by a pair of elastic pull ropes, and symmetrically installed on the base at both sides of the support tube.

9. The fitness ball chair according to claim 8, wherein each elastic pull rope has a ring belt disposed at an end of the elastic pull rope, and the ring belt includes a handle sheathed thereon, and each elastic pull rope has a connector disposed at the other end of the elastic pull rope.

10. The fitness ball chair according to claim 9, wherein the connector includes a connecting ring and a movable buckle, and the connecting ring is installed to the base, and the movable buckle is installed at the other end of the elastic pull rope, and the movable buckle is buckled with the connecting ring to define a connection for use.

11. The fitness ball chair according to claim 1, wherein the base has a plurality of cushions installed on a surface opposing to the fitness ball.

* * * * *